US005487919A

United States Patent [19]

Tobiyama et al.

[11] Patent Number: 5,487,919

[45] Date of Patent: Jan. 30, 1996

[54] METHOD OF MANUFACTURING OF GALVANIZED STEEL SHEET HAVING HIGH PRESS FORMABILITY

[75] Inventors: Yoichi Tobiyama; Chiaki Kato; Nobuyuki Morito; Hajime Kimura, all of Chiba, Japan

[73] Assignee: Kawasaki Steel Corporation, Hyogo, Japan

[21] Appl. No.: 175,682

[22] Filed: Dec. 29, 1993

Related U.S. Application Data

[63] Continuation-in-part of Ser. No. 71,938, Jun. 3, 1993, abandoned, which is a continuation of Ser. No. 756,528, Sep. 9, 1991, abandoned, which is a division of Ser. No. 636,233, Dec. 31, 1990, abandoned.

[30] Foreign Application Priority Data

Apr. 9, 1990 [JP] Japan ..... 2-93348
Nov. 30, 1990 [JP] Japan ..... 2-334296

[51] Int. Cl.[6] ..... B05D 3/00

[52] U.S. Cl. ..... 427/327; 427/372.2; 427/383.7; 427/398.2

[58] Field of Search ..... 427/327, 372.2, 427/383.7, 398.2

[56] References Cited

FOREIGN PATENT DOCUMENTS 1172578 7/1989 Japan .

*Primary Examiner*—Benjamin Utech
*Attorney, Agent, or Firm*—Dvorak and Traub

[57] ABSTRACT

A method of manufacturing a galvanized steel sheet with high press formability, the sheet having an inorganic compound on a metallic galvanized-layer thereof. The method includes the step of effecting a galvanization on a steel sheet followed by an alloying treatment. The sheet of galvanized steel is immersed in a bath of an aqueous solution containing 0.1 wt % or more of borate of an alkali metal, and then taking the steel sheet out of the bath and effecting such control as to make the amount of deposition of the water-containing borate film on the steel sheet surface to range from 10 to 1,000 mg/m$^2$, and then heating the steel sheet at a temperature ranging from 60° to 400° C. Thereafter, the steel sheet is cooled to a normal temperature.

2 Claims, 4 Drawing Sheets

METHOD OF MANUFACTURING OF GALVANIZED STEEL SHEET HAVING HIGH PRESS FORMABILITY

This application is a continuation-in-part of U.S. patent application Ser. No. 08/071,938 now abandoned, filed Jun. 3, 1993, which in turn is a continuation of U.S. patent application Ser. No. 07/756,528 now abandoned, filed Sep. 9, 1991, which in turn is a divisional of U.S. patent application Ser. No. 07/636,233 now abandoned, filed Dec. 31, 1990.

BACKGROUND OF THE INVENTION

1. Field of the Invention

The present invention relates to a galvanized steel sheet with a high press formability characteristic adapted for use as an automotive non-corrosion steel sheet and a method for manufacturing the same.

2. Description of the Prior Art

Recently, there has been an increasing demand for surface-treated steel sheets with high corrosion resistance in the fields of automobiles, household appliances, etc. To cope with this demand, alloy electroplated steel sheets, such as hot dip galvanized steel sheets, galvannealed steel sheets, electrogalvanized steel sheets, steel sheets electrogalvanized with Zn-Ni, etc., have been developed and placed into use.

When using these galvanized steel sheets with high corrosion resistance as automotive steel sheets, their physical or chemical properties, including press formability, weldability, chemical convertibility, etc., which are required in an automobile production line, are expected to be on levels equal to or higher than those of cold-rolled steel sheets that: have conventionally been used for the purpose.

The inventors hereof examined the press formability of those galvanized steel sheets. Thereupon, it was revealed that the galvanized steel sheets, in contrast with the conventionally used cold-rolled steel sheets, are subjected to so great a frictional resistance against a mold during press forming operation that their press formability is relatively low.

If this frictional resistance is great, the steel sheet is prevented from being smoothly introduced into those portions which are subjected to hard sliding motion, such as a bead portion of a press mold for fixing the steel sheet at the time of press forming. In an extreme case, the steel sheet may be broken. Since the proper cushion pressure range (range of cushion pressure within which the steel sheet cannot be wrinkled or broken) of the galvanized steel sheets for the press forming is much narrower than that of the cold-rolled steel sheets, the galvanized sheets are poorer in productivity. Therefore, an improvement of the frictional characteristics of the galvanized steel sheets is urgently needed.

The frictional characteristics experienced during a press forming operation are greatly influenced by the properties of the plating surface which is directly in contact with the mold. Accordingly, the frictional characteristics are tentatively improved by coating the plating surface with some material other than a zinc plating, e.g. an organic high molecular film, so that the plating surface is kept from direct contact with the mold and is lubricated.

A method for improving the formability of a steel sheet by improving the frictional characteristics of the sheet surface is disclosed in Published Examined Japanese Patent Application No. 61-26600, for example. According to this method, a specific organic high molecular film is formed on the steel sheet surface. Further, a lubricated-surface steel sheet is proposed which is coated with a film composed mainly of metallic soap or higher fatty acid wax, for example.

However, these steel sheets having the organic film thereon are subject to the following problem.

When galvanized steel sheets are used for automotive purposes, they are usually phosphated before being coated after the press forming operation. In doing this, however, the organic film partially remains on the steel sheet without being thoroughly removed by alkali degreasing as a pretreatment for the phosphating process. Therefore, a normal crystal of a phosphate on galvanized layer cannot be produced by the phosphating process. As a result, the adhesion of the coating film is lowered, so that the corrosion resistance of the coated steel sheet is deteriorated.

Disclosed in Published Unexamined Japanese Patent Application No. 1-172578, moreover, is a method in which the frictional characteristics obtained during press forming operation are improved by forming anhydrous alkaline metal salts of oxides of one or more metalloids, selected from a group of elements including boron, phosphorus, silicon, selenium, antimony, and tellurium, on a zinc-based plating. Also in this method, however, the solubility of the alkaline metal salts of the oxides of the metalloids, which are anhydrous crystals, is much poorer than that of hydrous crystals. Therefore, the film partially remains on the steel sheet without being thoroughly removed by the alkali degreasing before the phosphating process, thus entailing the same problem as aforesaid.

SUMMARY OF THE INVENTION

The object of the present invention is to provide a galvanized steel sheet having better frictional characteristics and considerably improved in press formability without lowering the phosphatability thereof.

According to one aspect of the present invention, there is provided a galvanized steel sheet with high press formability, comprising an inorganic compound on a metallic deposit, the friction coefficient of the galvanized steel sheet being 80% or less of the friction coefficient obtained without the existence of the inorganic compound, and the amount of insoluble slimes of the inorganic compound left after water washing or alkali degreasing being less than 1 mg/m$^2$.

According to another aspect of the invention, there is provided a method for manufacturing a galvanized steel sheet with high press formability, comprising steps of bringing the plating surface of the galvanized steel sheet into contact with a water solution containing 0.1 wt % or more of a borate of alkaline metal, and drying the steel sheet by heating within a temperature range of 60° to 400° C.

The above and other objects, features, and advantages of the invention will be more apparent from the ensuing detailed description taken in connection with the accompanying drawings.

DETAILED DESCRIPTION OF THE PREFERRED EMBODIMENTS

Figure 1:
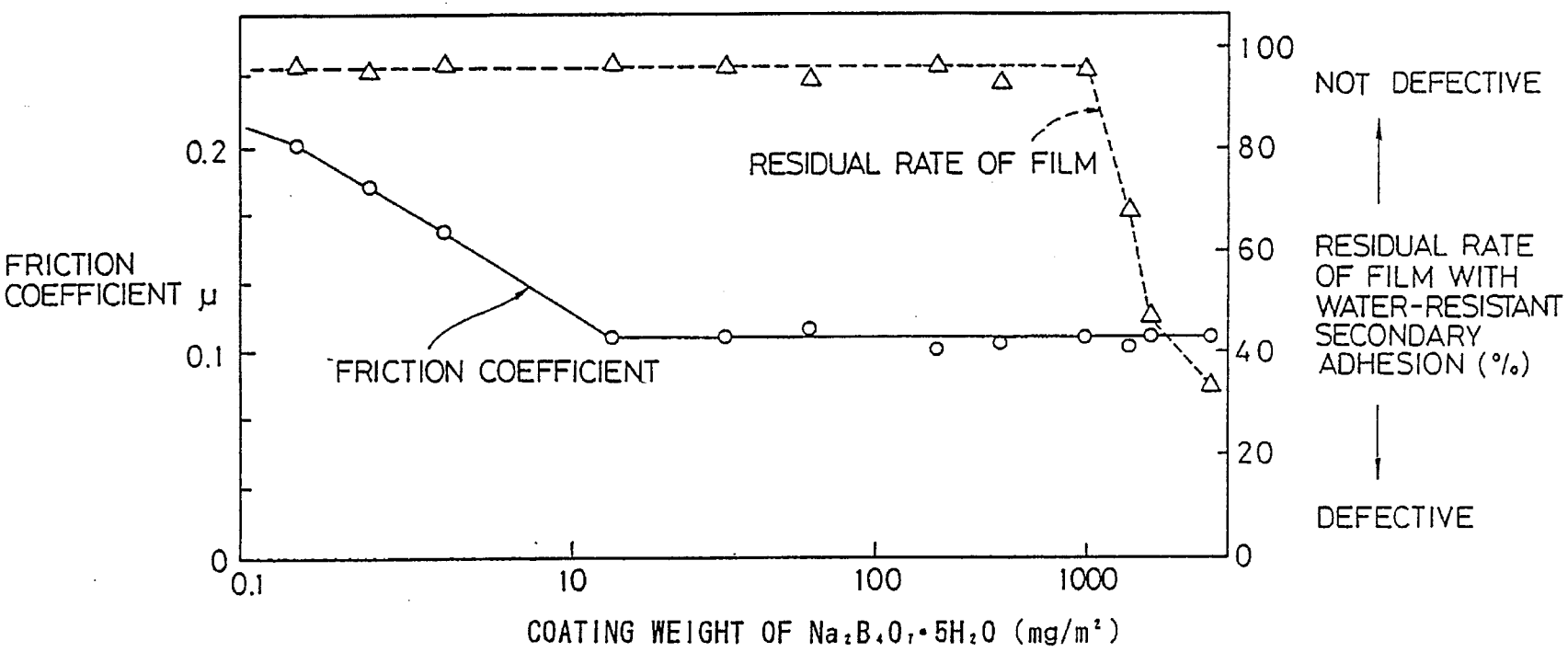
FIG. 1*a* is a diagram showing the relationship between water content of borate film and post-application baking/dehydration temperature (or sheet temperature at atomization.

The inventors hereof examined the relationship between the coefficient of friction and press formability of a galvanized steel sheet. Thereupon, it was observed that the friction coefficient of a galvanized steel sheet, subjected to galvanizing such as electrogalvanizing, galvannealing, etc., is 0.15 or more, compared with about 0.10 for that of a conventional cold-rolled steel sheet with high press formability. In the present invention, the friction coefficient is a value which is obtained by oiled-state measurement in a draw-bead extraction test.

It was concluded that the galvanized steel sheet has such a high friction coefficient because zinc and zinc alloy have so low a melting point and so great an affinity for other metals, especially for cast iron and the like frequently used for press molds, that they can easily stick to a mold. Since the frictional characteristics during press forming are influenced by the properties of the plating surface which is brought directly into contact with the mold, it was supposed that the frictional characteristics can be improved by coating the plating surface with some other material than a zinc plating so that the un-coated plating surface is kept from direct contact with the mold and is lubricated. The inventors continued the examination to find that the aforementioned problem on the press forming can be solved by providing a specific inorganic compound on the plating surface so that the resulting friction coefficient is 80% or less of the friction coefficient obtained without any specific substance on the plating surface, preferably 0.15 or less.

In this case, however, it was revealed that most of the inorganic compound must be removed by dissolution in a degreasing process preceding a process in which a steel sheet is phosphated in an automobile production line, in order to reconcile the press formability and phosphatability.

The present invention will now be described in detail.

A galvanized steel sheet according to the invention has an inorganic compound on its metallic galvanized layer.

Such galvanized steel sheets include galvannealed steel sheets, hot dip galvanized steel sheets, electrogalvanized steel sheets, steel sheets electrogalvanized with alloyed zinc, such as Zn-Ni, Zn-Fe, etc., and steel sheets flashed with Fe-P, Fe-Zn, etc., for example.

The inorganic compound should be one whose friction coefficient can be lowered when it exists on the metallic galvanized layer of the galvanized steel sheet, and the greater part of which can be removed by dissolution in water or by alkali degreasing. Any inorganic compounds may be used for the purpose provided they fulfill these requirements.

Inorganic compounds suitably used according to the present invention include borates, carbonates, phosphates, sulfates, nitrates, chlorides, hydroxides, and oxides of alkaline metals such as Na and K, alkaline earth metals such as Ca and Mg, and metals or metalloids such as Fe, Ni, Co, Al, Ti, Si, etc., for example.

The galvanized steel sheet according to the present invention can be easily manufactured by bringing the steel sheet into contact with a water solution of the inorganic compound and then drying the resulting sheet, as mentioned later. For ease of manufacture, therefore, the inorganic compound is expected to be water-soluble. Further, the inorganic compound should preferably be low-priced, in view of costs, and be highly soluble in water or basic aqueous solutions, since it is to be dissolved and removed by water washing or alkali degreasing.

In consideration of these factors, salts of alkaline metals, among the other inorganic compounds described before, are particularly suited for the purpose. Above all, hydrous borates of alkaline metals are very effective for the improvement of the frictional characteristics, and they typically include borax (sodium tetraborate: $Na_2B_4O_7 \cdot 10H_2O$) which can be industrially mass-produced and is low-priced.

The hydrous borates of alkaline metals greatly surpasses an anhydrous one in solubility in water for washing or alkali for alkali degreasing. Thus, film is thoroughly dissolved by the alkali degreasing preceding the phosphating, and never remains on the steel sheet at all. This is the reason why hydrous borates of alkaline metals are preferably used,.

According to the present invention, the inorganic compound on the zinc-based plating is not limited in form. By way of example, a filmy or particulate compound is used for the purpose.

According to the present invention, moreover, the coating weight of the inorganic compound on the surface of the galvanized steel sheet has to be adjusted so that the friction coefficient of the galvanized steel sheet with the inorganic compound on plated layer is 80% or less of that of a galvanized steel sheet with no inorganic compound thereon, preferably 0.15 or less at the absolute value of coefficient of friction.

If the friction coefficient exceeds 80% of that of the galvanized steel sheet without the inorganic compound, the press formability cannot be regarded as improved. The amount of insoluble slimes of the inorganic compound should be less than 1 $mg/m^2$ at the end of the degreasing process before the phosphating process, lest the production of a satisfactory phosphate crystal be hindered during the phosphating process.

According to the present invention, furthermore, the coating weight of a hydrous borate of alkaline metal is restricted to a range of 10 to 1,000 $mg/m^2$ for the following reasons. If the coating weight is less than 10 $mg/m^2$, a satisfactory improvement of the frictional characteristics cannot be achieved. If the coating weight exceeds 1,000 $mg/m^2$, on the other hand, the effect of the improvement of the frictional characteristics is saturated, and besides, the film partially remains on the plated layer without being thoroughly removed in the degreasing process before the phosphating process, thus exerting a bad influence on the subsequent phosphating process. Preferably, the coating weight ranges from 100 to 1,000 $mg/m^2$. If the coating weight of the hydrous borate of alkaline metal is excessive, then the degreasing effect of a degreasing solution before the phosphating process will be lowered. FIG. 1 shows the relationships between the coating weight of borax (sodium tetraborate: $Na_2B_4O_7 \cdot 5H_2O$) on a galvannealed steel sheet, the coefficient of friction obtained in a frictional characteristic test, and the water-resistant secondary adhesion. These individual tests are conducted in the manner described later in connection with various examples. As shown in FIG. 1, the frictional characteristics can be greatly improved without affecting satisfactory phosphatability in the case where the coating weight of borax ranges from 10 to 1,000 $mg/m^2$.

A galvanized steel sheet having the aforesaid film of the hydrous borate of alkaline metal thereon may be manufactured in the following manner. The galvanized steel sheet is brought into contact with a water solution containing 0.1 wt % or more of the borate of alkaline metal by dipping, spraying, or coating by means of a roll coater or the like, and is then dried by heating within a temperature range of 60° to 400° C. The borate content of the alkaline metal is adjusted to 0.1 wt % or more for the following reason. If it is lower than 0.1 wt %, an excessive amount of water solution is required before the drying process for adhesion to obtain the minimum necessary coating weight or 10 mg/m$^2$ of the film of the borate of alkaline metal on the zinc-based plating. Thus, the present method, in which the galvanized steel sheet is dried by heating after being brought into contact with the aqueous solution, entails some operational disadvantages, such as lowering of line speed.

The lower limit of the heating temperature range for the drying is adjusted to 60° C. because if the heating temperature is lower than 60° C., a solid film effective for the improvement of the frictional characteristics as aforesaid cannot be formed on the plating. The upper limit is set at 400° C. because if the sheet is heated to a temperature exceeding 400° C., the hydrous crystal of the borate of alkaline metal turns into an anhydrous crystal, so that borate film turns into one, which is difficult to dissolve.

Figure 2:
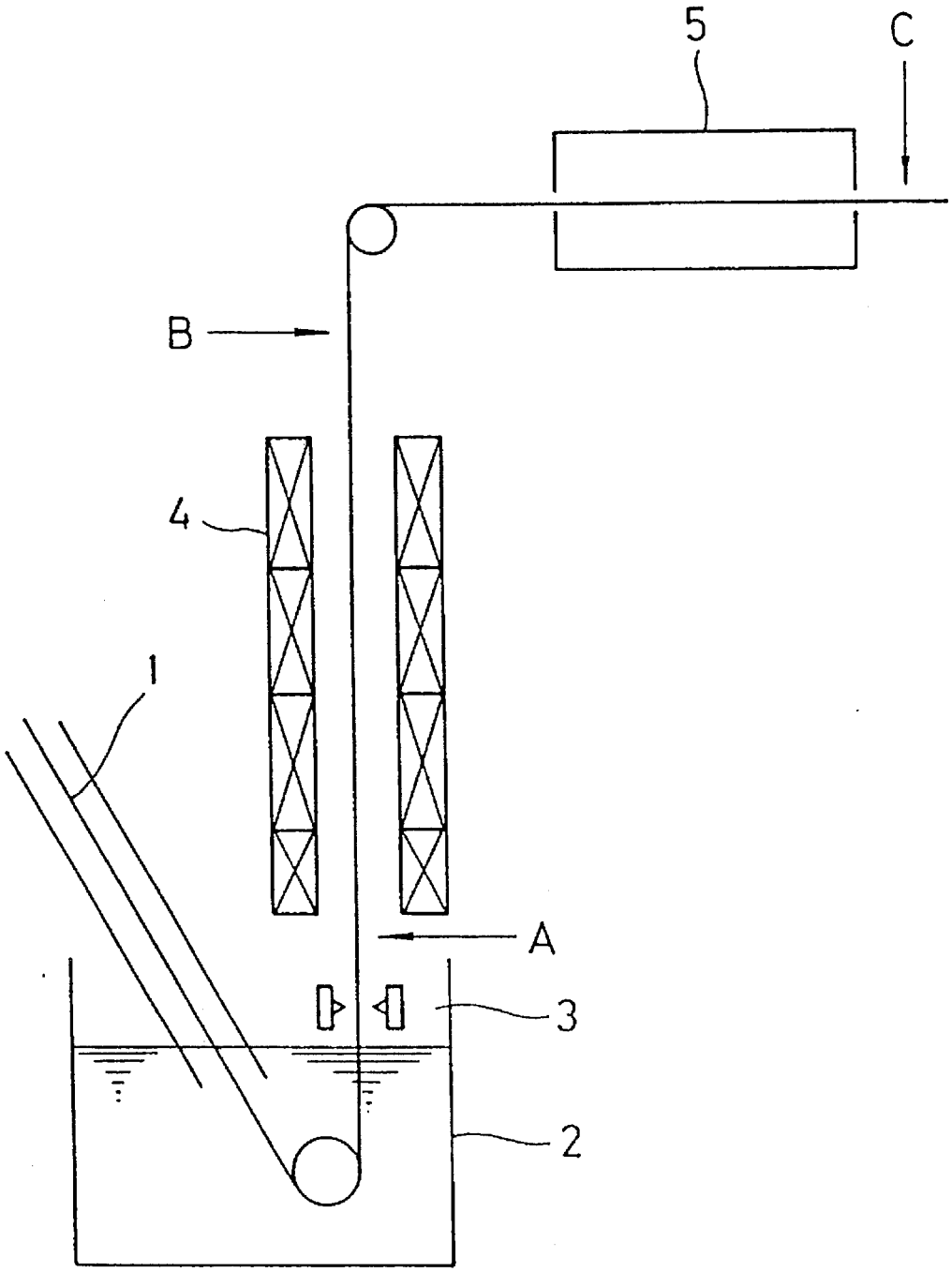

FIG. 2 shows a process for manufacturing the galvanized steel sheet. In FIG. 2, numeral 1 denotes the steel sheet; 2, a hot zinc pot; 3, coating weight control means; 4, a galvannealing :furnace; and 5, a cooling zone. When the temperature of the steel sheet is within the temperature range of 60° to 400° C. after melt plating or after galvannealing subsequent thereto, a aqueous solution containing the aforesaid borate of alkaline metal is sprayed so that the steel sheet is brought into contact with a mist of the solution. Thus, a film similar to the film obtained by bringing the steel sheet into contact with the water solution at room temperature and then drying the sheet by heating can be manufactured at very low cost. The solution containing the borate of alkaline metal may be sprayed at any positions kept at a temperature within the temperature range for the steel sheet. For example, the spraying can be effected at positions A, B and C of FIG. 2, which will be described later in connection with the examples.

EXAMPLE 1

After an aqueous solution containing 0.6 wt % of sodium tetraborate ($Na_2B_4O_7 \cdot 10H_2O$) was applied to an electrogalvanized steel sheet (EG) with the coating weight of 60/60 g/m$^2$ by means of a roll coater, the resulting sheet was dried by heating such that the sheet temperature attained 200° C. at the maximum.

EXAMPLE 2

After a steel sheet electroplated with Zn-Ni alloy and having the coating weight of 30/30 g/m$^2$ and Ni content of 11/11% was dipped in an aqueous solution containing 10 wt % of sodium dihydrogen phosphate ($NaH_2PO_4 \cdot 2H_2O$), it was dried by means of warm air such that the sheet temperature attained 60!n at the maximum.

EXAMPLE 3

After an aqueous solution containing 5 wt % of dipotassium hydrogen phosphate ($K_2HPO_4$) was sprayed on the plating surface of a steel sheet one-sidedly electroplated with Zn-Fe alloy having the coating weight of 20 g/m$^2$ and Fe content of 12%, the resulting sheet was dried by heating by means of hot air of 70° C.

EXAMPLE 4

In a manufacturing process for a hot dip galvanized steel sheet (GI) with the coating weight of 90/90 g/m$^2$, a aqueous solution containing 5 wt % of potassium tetraborate ($K_2B_4O_7 \cdot 4H_2O$) was sprayed on the steel sheet at a position (position A of FIG. 2) reached immediately after the steel sheet is wiped over the melt plating pot. The sheet temperature immediately before the spraying was 380° C.

EXAMPLE 5

In a manufacturing process for a galvannealed steel sheet (GA) with the coating weight of 45/45 g/m$^2$ and alloy content of 9/9%, a aqueous solution containing 0.7 wt % of sodium metaborate ($NaBO_2 \cdot 4H_2O$) was sprayed on the steel sheet at a position (position B of FIG. 2) reached immediately after the steel sheet gets out of the alloying furnace. The sheet temperature immediately before the spraying was 250° C.

EXAMPLE 6

After a aqueous solution containing 1.0 wt % of sodium tetraborate ($Na_2B_4O_7 \cdot 10H_2O$) was applied to both sides of a galvannealed steel sheet with the coating weight of 60/60 g/m$^2$ and alloy content of 10/10% by means of the roll coater, the resulting sheet was dried by heating such that the sheet temperature attained 130!n at the maximum.

Comparative Example 1

An electrogalvanized steel sheet with the coating weight of 60/60 g/m$^2$ (equivalent to the green material of Example 1).

Comparative Example 2

A steel sheet electroplated with Zn-Ni alloy having the coating weight of 30/30 g/m$^2$ and Ni content of 11/11% (equivalent to the green material of Example 2).

Comparative Example 3

A steel sheet one-sidedly electroplated with Zn-Fe alloy having the coating weight of 20 g/m$^2$ and Fe content of 12% (equivalent to the green material of Example 3).

Comparative Example 4

A hot dip galvanized steel sheet with the coating weight of 90/90 g/m$^2$ (equivalent to the green material of Example 4).

Comparative Example 5

A galvannealed steel sheet with the coating weight of 45/45 g/m$^2$ and alloy content of 9/9% (equivalent to the green material of Example 5).

Comparative Example 6

A galvannealed steel sheet with the coating weight of 60/60 g/m$^2$ and alloy content of 10/10% (equivalent to the green material of Example 6).

Comparative Example 7

After an aqueous solution containing 5 wt % of alumina sol ($Al_2O_3$) was applied to an electrogalvanized steel sheet with the coating weight of 60/60 g/m$^2$ by means of the roll coater, the resulting sheet was dried by heating such that the sheet temperature attained 50° C. at the maximum.

Comparative Example 8

In a manufacturing process for a galvannealed steel sheet with the coating weight of 45/45 g/m$^2$ and alloy content of 9/9%, an aqueous solution containing 3 wt % of cobalt nitrate ($Co(NO_3)_2$) was sprayed on the steel sheet at the position (position B of FIG. 2) reached immediately after the steel sheet gets out of the galvannealing furnace. The sheet temperature immediately before the spraying was 300° C.

Comparative Example 9

Rust preventing oil containing 10 wt % of molybdenum sulfide ($MoS_2$) was applied to a steel sheet electroplated with Zn-Ni alloy having the coating weight of 30/30 g/m$^2$ and Ni content of 11/11%.

Comparative Example 10

In a manufacturing process for a galvannealed steel sheet with the coating weight of 60/60 g/m$^2$ and alloy content of 10/10%, an aqueous solution containing 0.8 wt % of sodium tetraborate ($Na_2B_4O_7 \cdot 10H_2O$) was sprayed on the steel sheet at the position (position B of FIG. 2) reached immediately after the steel sheet gets out of the galvannealing furnace. The sheet temperature immediately before the spraying was 420° C.

Evaluation tests were conducted in the following manner. Table 1 shows the results of these tests.

(a) Form and coating weight of inorganic compound film:

For each of Examples 1 to 6 and Comparative Examples 7 to 10, the inorganic compound film formed on the galvanized steel sheet was measured by thin-film X-ray diffractometry.

The coating weight of the film was measured as follows. After the surface layer portion of the film was dissolved in sulfuric acid, the resulting solution was subjected to ICP spectroscopic analysis, whereby individual elements were analyzed. The coating weight of the inorganic compound film on the galvanized steel sheet was determined by the chemical composition obtained from the resulting elemental analysis values and the results of the thin-film X-ray diffractometry.

(b) Solubility of inorganic compound for degreasing:

The inorganic compound film was degreased by spraying a degreasing solution, FC-4460 (produced by Nihon Parkerizing Co., Ltd.), of 40° C. for 120 seconds. For each of the resulting samples, the slimes of the inorganic compound were analyzed by the method (a).

Figure 3A:
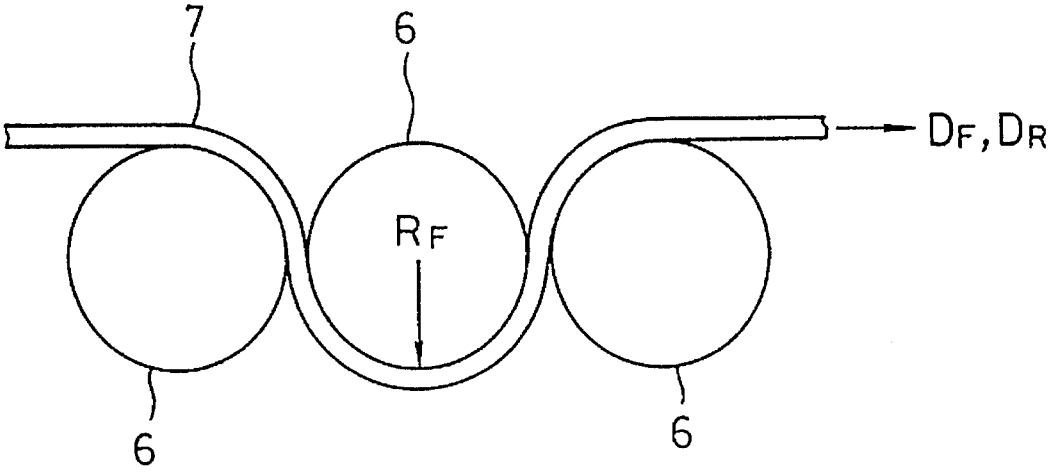
Figure 3B:
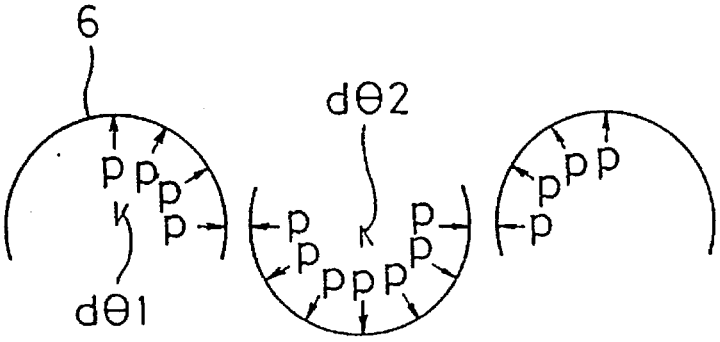

(c) Frictional characteristics:

The frictional characteristics were evaluated by the drawbead extraction test shown in FIGS. 3(*a*) and 3(*b*).

TABLE 1

| | Type of plating | Form of inorganic compound film | Coating weight of inorganic compound (mg/m$^2$)* | Solubility for degreasing: Insoluble slimes after degreasing (mg/m$^2$) | Frictional characteristics: Friction coefficient (μ) | Frictional characteristics: Friction coefficient ratio (%) | Phosphatability Chemically converted crystal size | Water-resistant secondary adhesion Residual rate of film (%) |
|---|---|---|---|---|---|---|---|---|
| Example 1 | EG | $Na_2B_4O_7.5H_2O$ | 60 | <0.1 | 0.10 | 33 | ○ | 95 |
| Example 2 | Zn—Ni | $NaH_2PO_4.2H_2O$ | 500 | 0.5 | 0.12 | 60 | ○ | 96 |
| Example 3 | One-sided Zn—Fe | $K_2HPO_4$ | 300 | 0.3 | 0.09 | 41 | ○ | 93 |
| Example 4 | GI | $K_2B_4O_9.4H_2O$ | 700 | <0.1 | 0.13 | 52 | ○ | 90 |
| Example 5 | GA | $NaBO_2.4H_2O$ | 150 | <0.1 | 0.11 | 48 | ○ | 98 |
| Example 6 | GA | $Na_2B_4O_7.5H_2O$ | 200 | <0.1 | 0.08 | 40 | ○ | 97 |
| Comparative Example 1 | EG | — | — | — | 0.30 | — | ○ | 94 |
| Comparative Example 2 | Zn—Ni | — | — | — | 0.20 | — | ○ | 95 |
| Comparative Example 3 | One-sided Zn—Fe | — | — | — | 0.22 | — | ○ | 94 |
| Comparative Example 4 | GI | — | — | — | 0.25 | — | ○ | 89 |
| Comparative Example 5 | GA | — | — | — | 0.23 | — | ○ | 93 |
| Comparative Example 6 | GA | — | — | — | 0.20 | — | ○ | 94 |
| Comparative Example 7 | EG | $Al_2O_3$ | 200 | 50 | 0.14 | 47 | x | 10 |
| Comparative Example 8 | GA | $Co(NO_3)_2$ | 100 | 0.5 | 0.19 | 83 | ○ | 94 |
| Comparative Example 9 | Zn—Ni | $MoS_2$ | 200 | 5 | 0.09 | 45 | x | 15 |
| Comparative Example 10 | GA | $Na_2B_4O_7$ | 100 | 40 | 0.12 | 60 | x | 20 |

More specifically, a force $D_F$ required for the extraction of a sample 7 when a roll 6 was fixed and a force $D_R$ required when the roll 6 was allowed to rotate were obtained, as shown in FIG. 3, and a friction coefficient μ of the sample 7 was calculated according to the following equation based on these two values, whereby the frictional characteristics were evaluated. For those samples which have an inorganic compound film, the friction coefficient ratio compared with 100% for the friction coefficient of a similar galvanized steel sheet (green material) was also calculated.

$$D_F - D_R = 2\mu p \int_0^{\pi/2} R d\theta_1 + \mu p \int_{-\pi/2}^{\pi/2} R d\theta_2 = 2\pi\mu p R,$$

$$P_F = 2p \int_{-\pi/2}^{\pi/2} R\cos\theta_2 d\theta_2 = 2pR,$$

where $\mu$ is the friction coefficient between the roll and the sample; p, force applied in the diametrical direction of the roll; R, roll radius; $\theta$, center angle; and $P_F$, thrust load of a center punch.

Thus, we obtain $\mu=(D_F-D_R)/(\pi P_F)$.

The test conditions are given as follows:

Sample size: 20 400 mm

Sliding speed: 500 mm/sec.

Distance of slide: 100 mm

Thrust load of center punch: 100 kgf

Cleaning oil: 0.5 g/m$^2$ (applied)

(d) Phosphatability:

Phosphating was effected using a treatment solution, PALBOND L3020 (produced by Nihon Parkerizing Co., Ltd.), and phosphate crystals were observed by means of a 1,500-power scanning electron microscope (SEM). The phosphatability was evaluated in accordance with the following criteria based on the crystalline grain size.

Average crystal size (μm) Decision

| Average crystal size (μm) | Decision |
|---|---|
| 10 or less | ○ |
| 10 to 20 | Δ |
| 20 or more | x |

(e) Water-resistant secondary adhesion:

After the phosphating process, the sample subjected to cation electrodeposition painting, intercoating, and finish coating was immersed in pure water of 40° C. for 10 days, and was then subjected to a checkered peeling test using an adhesive tape. Thus, the water-resistant secondary adhesion was evaluated on the basis of the residual rate of coating film.

According to the present invention, the water content in terms of the sum of the water contained in the water-containing borate film on the galvanized steel sheet and the crystalline water is determined to range from 20 to 70% for the following reasons.

Any water content below 20% causes insufficiency in the alkali defatting in phosphate treatment which is conducted following a press work.

Conversely, when the water content exceeds 70%, the film easily exfoliates by light rinsing with water. Consequently, the film is insufficiently formed so as to impair sliding characteristic during press work.

The density of the aqueous solution of borax (borate) to be applied as the film material and dehydrating temperature are important factors for forming a film having the water content of from 20 to 70%. More specifically, when the density of aqueous solution of borax (borate) is from 0.5 to 2.0 wt %, the water content of the film varies as follows according to the temperature of dehydration after the application or the steel sheet temperature to which the aqueous solution is atomized:

(1) When the dehydration is conducted at 60° C. (or when atomization is conducted at sheet temperature of 60° C.), the borate film is formed to have a water content of about 70%.

(2) When the dehydration is conducted at 100° C. (or when atomization is conducted at sheet temperature of 100° C.), the borate film is formed to have a water content of about 20 to 30%.

Figure 1A:
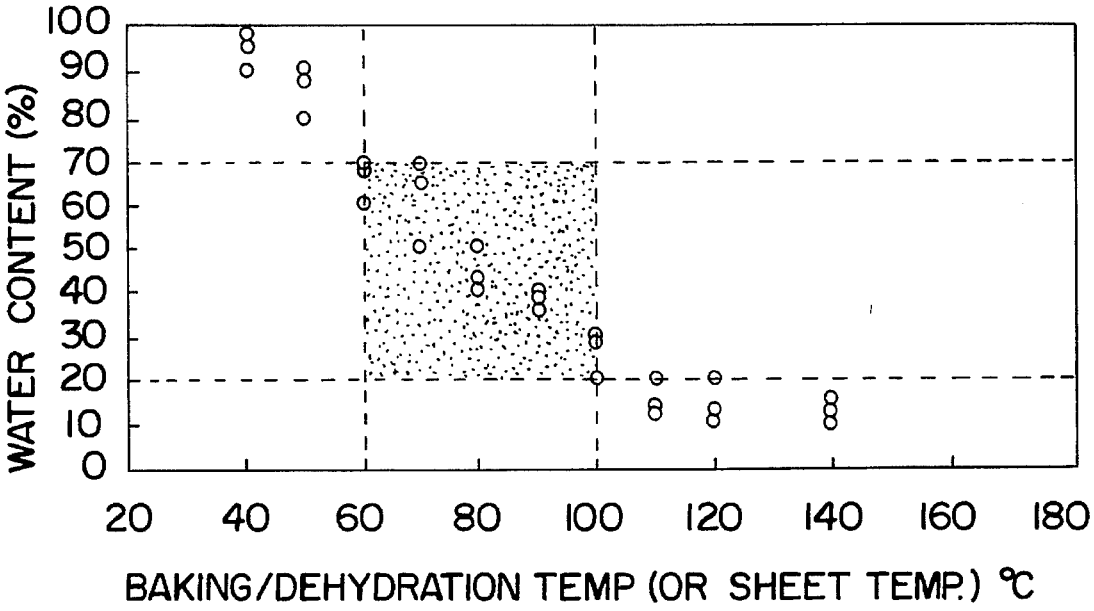

The attached FIG. 1*a* illustrates the relationship between the temperature (°C.) of baking dehydration conducted after application and the water content (%).

The water content is measured by making use of a phenomenon that $Na_2B_4O_7 \cdot 5H_2O$ is changed into anhydride when heated to 350°–400° C. Namely, weight of the borate formed at 60° to 100° C. is measured and is measured again after the film is heated to 350° to 400° C. The difference between two measured weights, i.e., the weight reduction, is the water content.

According to the present invention, as described herein, there may be provided a galvanized steel sheet whose press formability is considerably improved without lowering the phosphatability thereof.

The galvanized steel :sheet according to the present invention has the inorganic compound thereon which serves to improve the frictional characteristics of the steel sheet and can be substantially thoroughly removed by the alkali degreasing or water washing preceding the phosphating process, so that it can reconcile the press formability and phosphatability. Use of the galvanized steel sheet of the invention greatly improves the productivity for the press forming.

Further, the steel sheet can be easily manufactured at low cost by bringing the galvanized steel sheet into contact with the aqueous solution containing 0.1 wt % or more of the borate of alkaline metal and then drying the sheet by heating within the temperature range of 60° to 400° C., or by only spraying the aqueous solution on the steel sheet after the galvanizing or galvannealing process in the case of the hot dip galvanized steel sheet. Thus, the steel sheet of the present invention is easy to manufacture.

What is claimed is:

1. A method of manufacturing a galvanized steel sheet with high press formability, comprising the steps of:

(a) effecting a galvanization on a steel sheet followed by an alloying treatment;

(b) immersing said galvanized steel sheet in a bath of an aqueous solution containing 0.5 to 2.0 wt % of hydrous borate of an alkali metal;

(c) taking said steel sheet out of said bath and effecting such a control as to make a water-containing borate film on a surface of the steel sheet in a range from 10 to 1,000 mg/m$^2$;

(d) heating said steel sheet at a temperature ranging from 60° to 100° C. to dry said film and effecting such a control as to make the total water content, including water contained in the water-containing borate film and crystalline water contained in the water-containing borate film, in a range from 20 to 70%.

2. A method of manufacturing a galvanized steel sheet with high press formability, comprising the steps of:

(a) effecting a galvanization on a steel sheet followed by an alloying treatment;

(b) atomizing onto the galvanized surface of said steel sheet an aqueous solution containing 0.5 to 2.0 wt % of hydrous borate of an alkali metal;

(c) effecting such a control as to make a water-containing borate film on the steel sheet in a range from 10 to 1,000 $mg/m^2$;

(d) heating the galvanized steel sheet at a temperature ranging from 60° to 100° C. and effecting such a control as to make the total water content, including water contained in the water-containing borate film and crystalline water in the water-containing borate film, in a range from 20 to 70%.

* * * * *